US006807686B1

(12) United States Patent
Janes

(10) Patent No.: US 6,807,686 B1
(45) Date of Patent: Oct. 26, 2004

(54) EASILY REMOVABLE AND REPLACEABLE TOILET SEAT AND LID

(76) Inventor: Timothy T. Janes, 4921 Marine Ave., Lawndale, CA (US) 90260

( * ) Notice: Subject to any disclaimer, the term of this patent is extended or adjusted under 35 U.S.C. 154(b) by 0 days.

(21) Appl. No.: 10/800,247

(22) Filed: Mar. 15, 2004

(51) Int. Cl.[7] ..... A47K 13/00
(52) U.S. Cl. ..... 4/234; 4/236; 4/240
(58) Field of Search ..... 4/234, 236, 240; 411/41, 46, 48, 60.1

(56) References Cited

U.S. PATENT DOCUMENTS 5,933,875 A * 8/1999 Hulsebus et al. ..... 4/240
6,381,762 B1 * 5/2002 Moser ..... 4/240
6,643,851 B1 11/2003 Janes ..... 4/236

* cited by examiner

*Primary Examiner*—Tuan Nguyen
(74) *Attorney, Agent, or Firm*—Edgar W. Averill, Jr.

(57) ABSTRACT

An easily removable and replaceable toilet seat and hinge assembly. When it becomes necessary to clean the top of the toilet and seat and lid, a toilet seat and lid may be readily removed without having to remove the bolts which hold the seat and lid on the toilet. Instead, male and female clip members hold the seat to the toilet and may be readily snapped in and out of attachments to remove or replace a toilet seat and lid.

11 Claims, 3 Drawing Sheets

EASILY REMOVABLE AND REPLACEABLE TOILET SEAT AND LID

BACKGROUND OF THE INVENTION

The field of the invention is toilet seats and the invention relates more particularly to methods and devices for easily cleaning the lid and seat of a toilet. The present invention is an improvement over that shown in applicant's U.S. Pat. No. 6,643,851, which patent is incorporated herein by reference for purposes of background.

BRIEF SUMMARY OF THE INVENTION

The present invention is for an easily removable and replaceable toilet seat, lid, and hinge assembly attachable to a toilet of the type having a flat upper surface. The assembly is held against the flat upper surface by attachments means which include a pair of horizontal hinge pins affixed to the toilet seat, lid, and hinge assembly, each horizontal hinge pin hingedly supporting a tang supporting assembly, including a tang removably securable to a female support receptacle assembly affixed over each of two conventionally spaced vertical holes formed through said flat upper surface. The assembly has a seat and a lid held by a pair of seat arms and a pair of lid arms, each seat and lid arm supporting a hinge pin. A pair of tang supporting assemblies are held by said hinge pins and each support a tang having an arm movable between a locked position and an unlocked position. A pair of female support receptacle boxes are held on the flat surface. Each receptacle box has an opening into which said tang may be inserted and each receptacle box has a cover movable between a closed position and an open position. The cover has a movable lid which is adjacent to said arm when said cover is in a closed position and the tang is in its locked position. When said movable lid is moved into a position where it touches said arm, the contact with the lid moves said arm from its locked position to its unlocked position, whereby said toilet seat, lid, and hinge assembly may be removed. This permits easy cleaning of the flat upper surface of the toilet. In its normal attached configuration, said female support receptacle is protected by said cover while being operable from the exterior of said cover.

DETAILED DESCRIPTION OF THE INVENTION

Figure 1:
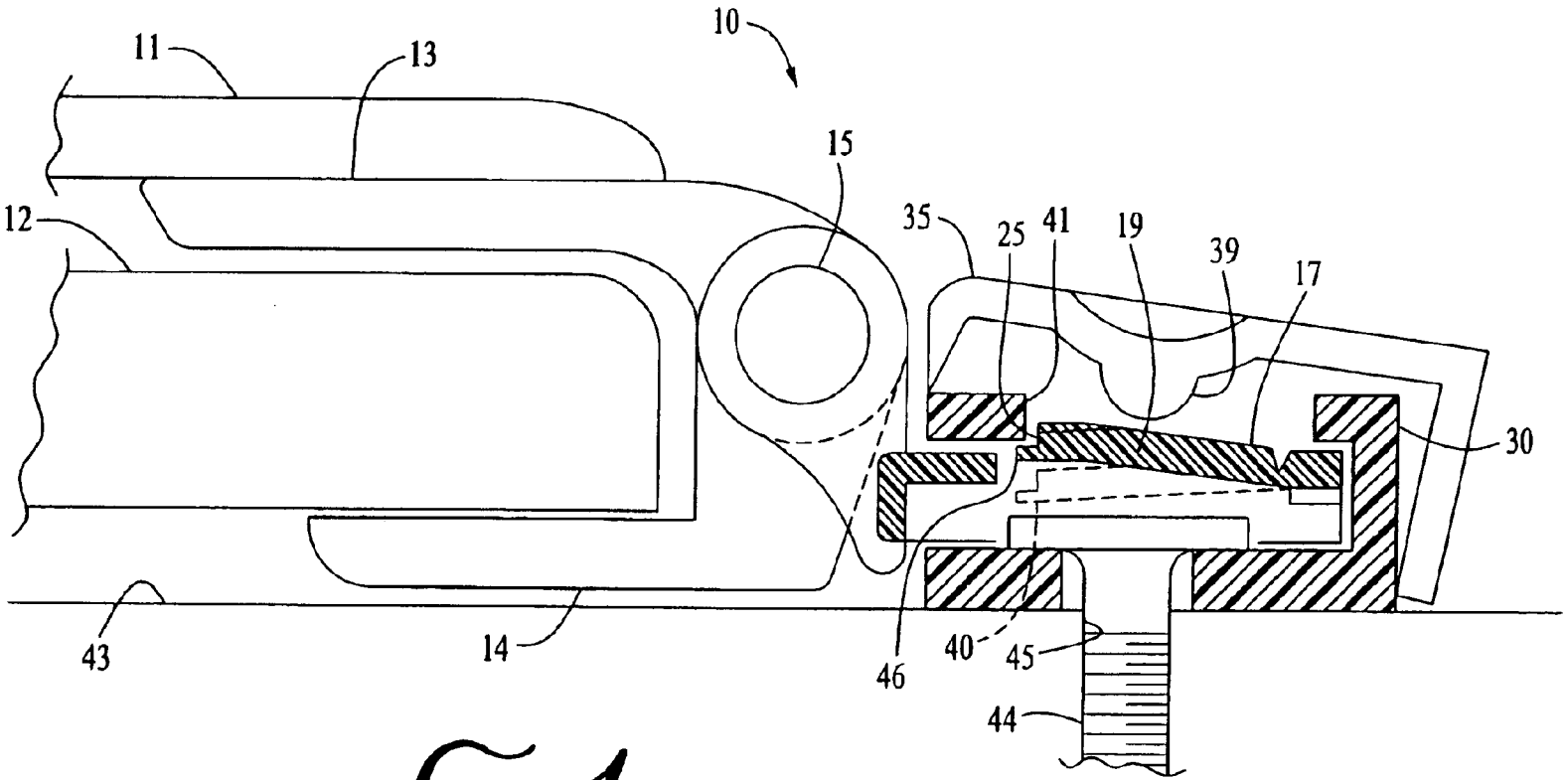
FIG. 1 is a side view partly in cross-section of the easily removable and replaceable toilet seat, lid, and hinge assembly of the present invention.

The easily removable and replaceable toilet seat, lid and hinge assembly is shown in side view in FIG. 1 and indicated generally by reference character 10. Assembly 10 holds a toilet seat lid 11, by way of a lid arm 13, and a toilet seat 12, by way of a seat arm 14. The lid arm and seat arm hold a hinge pin 15 which is one of a pair of hinge pins in the overall assembly. Hinge pin 15 holds a hinge pin supporting arm 16 shown best in FIG. 2. Hinge pin supporting arm 16 is a portion of and holds the tang supporting assembly to the lid and seat.

Figure 2:
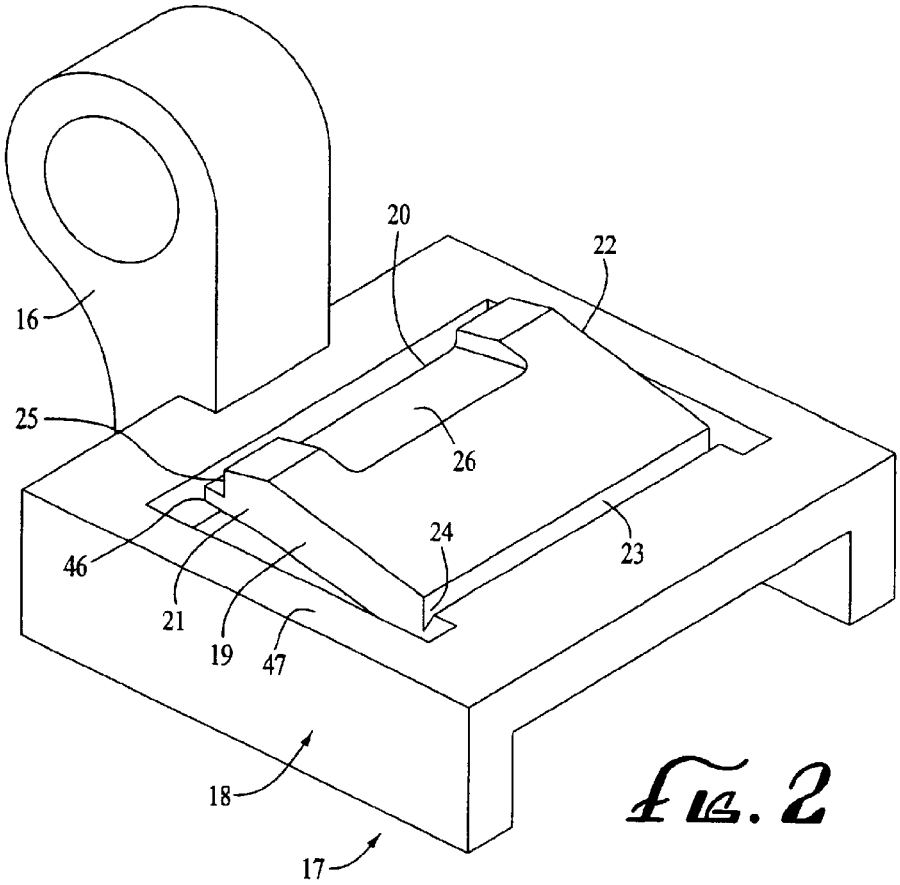
FIG. 2 is a perspective view of the tang supporting assembly thereof.

As shown in FIG. 2, the hinge pin supporting arm 16 is formed integrally with a tang 17 which has a tang frame 18. Tang 17 supports an arm 19. Arm 19 has forward side 20, a left side 21, a right side 22, and a rearward side 23. Rearward side 23 is flexibly cantilevered from tang frame 18 by way of a living hinge 24.

Forward side 20 has a stop edge 25 which is a portion of forward side 20. A central recess 26 is formed in the middle of forward side 20 and divides the stop edge into two halves.

Figure 3:
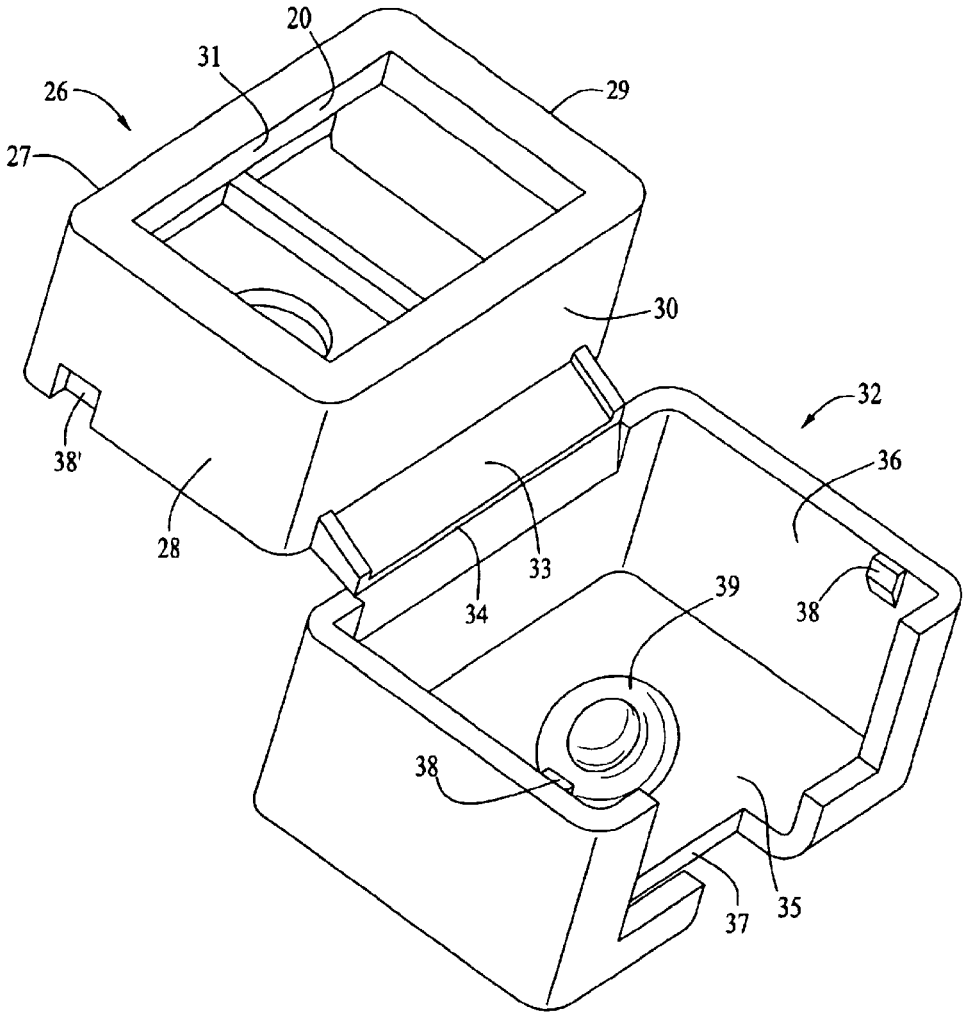
FIG. 3 is a perspective view of the female support receptacle box thereof.

The details of the female support receptacle box 26 are shown in FIG. 3. Box 26 has an opening 20 into which tang 17 may be inserted. Box 26 has a front side 27, a left side 28, a right side 29 and a rear side 30. The tang 17, as shown in FIG. 2, when inserted in opening 20 forces the depressable arm 19 downwardly until the stop edge 25 goes past the contact bar 41 of box 26, as shown in FIG. 1. At that point, the tang is locked into the box. Tang frame 18 has a top surface 47. The depressable arm 19 rises above the top surface 47 when in its locked position and moves below the top surface when the cover is depressed to release the tang from the female support receptacle box 26.

Box 26 has a cover 32 which is hingedly held by arm 33 by way of living hinge 34. Cover 32 has a lid 35 and side walls 36 which protect the interior of box 26 when the cover is closed, as is clear from viewing FIG. 1. Cover 32 has a recess 37 which surrounds a portion of hinge pin supporting arm 16 when the cover is in a closed position. The side walls 36 support a pair of protrusions 38 which snap into a pair of recesses 38' to hold the cover in a closed position.

The operation of the assembly is seen best by viewing FIG. 1 where movable lid 35 is shown with a protrusion 39 on an underside thereof which contacts the depressable arm 19. The cover 32 is normally in the position shown in FIG. 1 when the assembly is locked in place. The cover, however, may be moved downwardly with respect to that shown in solid line in FIG. 1 to the position shown in phantom line wherein the protrusion 39 moves the depressable arm to its unlocked position 40. The stop edges 25 move below stop bar 41 and permit the tang 17 to be pulled outwardly from the support receptacle box 26. The tang supporting assembly 17 is held to the flat upper surface 43 of the toilet by a conventional toilet bolt 44 which passes through conventionally spaced vertical holes 45 and a flat upper surface 43 of the toilet.

Preferably, a stop arm 46 is formed below stop edge 25 to limit the upward movement of depressable arm 19 and to provide an audible click when the flexible arm is latched. The assembly of the present invention is especially clean and because of the positioning of cover 32 over the tang, the interior of the closed box is protected from soiling from use of the toilet. The assembly is easily removed and easily replaced for cleaning with a minimum of time and effort.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. An easily removable and replaceable toilet seat, lid, and hinge assembly attachable to a toilet of the type having a flat upper surface, said toilet seat, lid and hinge assembly being held against the flat upper surface by attachment means including a pair of horizontal hinge pins affixed to said toilet seat, lid and hinge assembly each horizontal hinge pin hingedly supporting a tang supporting assembly including a tang removably securable into a female support receptacle assembly affixed over each of two conventionally spaced vertical holes formed through said flat upper surface, said easily removable and replaceable toilet seat, lid, and hinge assembly comprising:

a seat and a lid held by a pair of seat arms and a pair of lid arms, each seat and lid arm supporting a hinge pin;

a pair of tang supporting assemblies each held by said hinge pin and supporting a tang having a depressable arm movable between a locked position and an unlocked position; and a pair of female support receptacle boxes each having an opening into which said tang may be inserted and said female support receptacles having a cover moveable between a closed position and an open position, said cover having a movable lid which is adjacent said depressable arm when said cover is in a closed position and said tang is in its locked position and wherein said movable lid is moveable into a position wherein it touches and moves said depressable arm from its locked position to its unlocked position whereby said toilet seat, lid and hinge assembly may be removed and whereby said female support receptacle is protected by said cover while being operable from the exterior of said cover.

2. The assembly of claim 1 wherein said cover is hingedly held to a side of said female support receptacle box to permit said cover to move between an open position and a closed position.

3. The assembly of claim 1 wherein said moveable lid of said cover has an undersurface having a protrusion which contacts said depressable arm when said cover in a closed position and is depressed, said protrusion moving said depressable arm to its unlocked position.

4. The assembly of claim 1 wherein said moveable lid of said cover has a plurality of side walls which depend downwardly when said cover is in a closed position.

5. The assembly of claim 1 wherein said female support receptacle box is generally rectangular in shape having a front side, a right side, a left side and a rear side and said opening of said female support receptacle is located in said front side.

6. The assembly of claim 5 wherein said cover is hingedly attached to said female support receptacle box along an outer edge of an arm attached to the rear side of said female support receptacle box.

7. The assembly of claim 6 wherein said depressable arm is rectangular in shape and is elastically moveably supported adjacent said rearward side so that a stop portion of said forward edge of said depressable arm extends above a top surface of said tang when said depressable arm is not depressed.

8. The assembly of claim 7 wherein said tang supporting assembly has a hinge pin supported arm.

9. The assembly of claim 7 wherein said stop edge has a central recess along a portion of a top edge of said forward side of said depressable arm.

10. The assembly of claim 5 wherein said depressable arm has at least three rectangular sides having a forward side, a right side, a left side, and a rearward side.

11. The assembly of claim 10 wherein said opening of said female support receptacle has a contact bar positioned over a top of said opening which contact bar contacts said stop edge of said depressable arm when said tang is not depressed and permits said stop edge to pass below said contact bar when said tang is depressed.

* * * * *